United States Patent [19]

Chang

[11] 4,396,347

[45] Aug. 2, 1983

[54] ENERGY SAVING PUMP AND PUMPING SYSTEM

[76] Inventor: Kai-Chih Chang, 2339 Davison Ave., Richland, Wash. 99352

[21] Appl. No.: 264,558

[22] Filed: May 18, 1981

[51] Int. Cl.[3] ..... F04D 5/00

[52] U.S. Cl. ..... 415/53 R; 415/98; 415/175

[58] Field of Search ..... 415/53 R, 87, 198.2, 415/102, 103, 153 A, 152 A, 152 R, 11, 37, 53 T, 55, 58, 98, 213 T, 500; 416/184

[56] References Cited

U.S. PATENT DOCUMENTS

| | | | |
|---|---|---|---|
| 885,867 | 4/1908 | Salzer | 415/186 |
| 888,654 | 5/1908 | Prindle | 415/102 |
| 1,158,978 | 11/1915 | Buchi | 415/87 |
| 1,213,889 | 1/1917 | Lawaczeck | 415/186 |
| 1,260,639 | 3/1918 | Carter | 415/153 A |
| 1,456,051 | 5/1923 | Carter | 415/153 A |
| 2,073,733 | 3/1937 | Doty | 415/53 R |
| 2,426,950 | 9/1947 | Riede | 415/198.2 |
| 2,701,530 | 2/1955 | Schellerer | 415/153 A |
| 3,246,605 | 4/1966 | Fisher | 415/90 |
| 3,336,876 | 8/1967 | Streuli | 415/198.2 |
| 3,794,456 | 2/1974 | Jelusic | 415/153 A X |
| 3,944,406 | 3/1976 | Jagusch et al. | 415/98 X |

FOREIGN PATENT DOCUMENTS

| | | | |
|---|---|---|---|
| 657750 | 2/1963 | Canada | 415/153 A |
| 64328 | 3/1946 | Denmark | 415/202 |
| 2249510 | 4/1973 | Fed. Rep. of Germany | 415/98 |
| 36330 | 3/1906 | Switzerland | 415/187 |
| 30009 | of 1909 | United Kingdom | 415/98 |
| 167486 | 11/1921 | United Kingdom | 415/53 R |
| 215390 | 6/1968 | U.S.S.R. | 415/98 |

OTHER PUBLICATIONS

"Centrifugal Pumps" Igor Karassik and Roy Carter pp. 240–245, Dodge Corporation, NY, NY.

"Chemical Engineering Handbook" Perry and Chilton, 5th Edition McGraw—Hill Book Co., pp. 24/36–24/45.

"Fluid Mechanics of Turbomachinery", George Wislicenus, 1st Edition McCraw—Hill Book Co. Inc. 1947.

*Primary Examiner*—Philip R. Coe

*Assistant Examiner*—Frankie L. Stinson

[57] ABSTRACT

A centrifugal pump and a pumping system that recover hydraulic energy in response to flow capacity reduction and spontaneously provide a recirculating flow at low capacities when pump cooling is needed. From a upstream source the fluid is guided by two suction lines to two parallel pumping mechanisms housed by a common discharge casing. Said pumping mechanisms have a combined hydraulic characteristic that the first pumping mechanism will force a reverse flow through the second pumping mechanism, when pump discharge is reduced by the system below a certain low flow rate. The reverse flow will then return to the upstream fluid source through a suction line. The pump is thereby protected from overheating by a circulating flow at low flow capacities. At the same time, said reverse flow generates a turbine action on the second pumping mechanism and transmits the contained hydraulic energy back to the rotor and thereby results in power saving at low flow capacities.

8 Claims, 7 Drawing Figures

ENERGY SAVING PUMP AND PUMPING SYSTEM

BACKGROUND OF INVENTION

This invention relates to a flow machine and more specifically it relates to a centrifugal pump having a unique hydraulic characteristic that the pump spontaneously establishes a circulating flow through the pump housing when pump flow is reduced to the level that pump cooling is needed. The present invention also relates to energy saving at low pumping capacities in which the hydraulic energy of the circulating flow is recovered by a turbine action, which is otherwise wasted in a conventional pumping system.

Protecting pumps from overheating at shutoff and at very low capacities is one of the most common and troublesome problems concerning centrifugal pump applications. A thermodynamic phenomenon is that a centrifugal pump always converts a part of the mechanical power into heat when running. At very low capacities most shaft power consumed is converted into wasteful heat in the pump casing, which soon becomes excessive to the heat removal capability of the throughflow. The unbalanced heat will raise the liquid temperature in the pump and eventually cause pump component damage and plant operation problems.

Operating centrifugal pumps at shutoff and near shutoff is frequently required in pump installations. For example, in a boiler feed pump installation the demanded flow capacity may vary from zero to full pump capacity depending upon the load on the turbogenerator at the moment. Centrifugal pumps in safety related applications are normally on standby with the main discharge valve closed while descaling pump installations require frequent flow reductions near zero capacities. Even for general services, pump overheating protection can not be overlooked. For a common operating procedure calls for closing the downstream valve of the main discharge line at a pump startup. Then the pump must run at shutoff at least for the period before the valve is allowed to open by the procedure.

A common solution to the pump overheating problem is to install a bypass recirculation line for returning a certain flow from the discharge side of the pump to the upstream reservior. The return line is generally equipped with an orifice or a series of orifices for reducing the discharge pressure and, at the same time, dissipating the hydraulic energy as heat. The recirculation can be either kept continuously open or controlled by an on-off valve such that the bypass opens only when pumping capacity is reduced substantially lower than the rated capacity. The continuous recirculation system is most simple to install and to operate and it is absolutely safe. However the system requires an oversized pump to provide the rated main flow plus the bypass flow. A more serious disadvantage is that it wastes unnecessary energy in the recirculating flow when pump cooling is not needed. It is very often that the annual power costs for maintaining the excessive recirculation may run higher than the installation costs of the pump itself. This energy wasting feature is most undesirable and intolerable in the practice of pump applications. Unfortunately, continuous recirculation system is still in use, for it is the only available practical solution for overheating protection in many pump installations, especially for small scale pumping systems.

The modern pump installations set trends to control the system flow with automatic control devices. In this case the bypass must be either continuously open, as previously mentioned, or controlled automatically in response to the system flow variation. An automatic bypass control system consists, in general, a flow sensor for determining the flow rate at the moment, a signal rely to the bypass valve, a bypass valve actuator, an external power source for driving the bypass valve and some other electronic and mechanical components. For instance, to control the bypass flow of a boiler feed pump of a power plant the control system further requires a back-up manual valve on the bypass line, a valve position indicator and an alarm system for warning the operator in case the bypass fails to open. The installation and maintenance of this system are extremly expensive and it is unpractical for most pump applications.

Even with the burden of the high costs of the automatic control, the problem is not solved in a satisfactory manner. On one hand the bypass control system has potential hunting problem near the flow setpoint and on the other hand the main system flow experiences flow shocks as the bypass valve in motion. It is a common practice to increase the flow setpoint of the bypass control to that of twice of the minimum safe flow rate in order to avoid hunting. This will however further aggravate the flow shock problem of the system flow. In addition, it wastes energy for maintaining the extra recirculating flow. Multiple bypass system is sometimes used for mitigating the system flow shocks. This means even higher initial and maintenance costs and more complicated operation.

Many engineers and pump designers have continuously searched for better solutions to the problem of pump overheating protection. Useful improvements have been made in the areas of bypass design, orifice selection, component design for bypass valves and control system design. However, as mentioned above, no ideal solution is yet available for pump operation in the low flow range. It has been always my belief that the pump overheating problem can and should be solved from the source of the problem, namely the pump design. In the present disclosure I shall disclose an invention relates to a centrifugal pump that spontaneously responses to flow reduction to generate circulating cooling flow that protects the pump from overheating at low capacities. As a result, no external bypass control is needed and no wasteful energy is consumed, in accordance with the present invention.

OBJECTS OF THE INVENTION

The objects of the present invention include:

(1) To provide a new and improved pumping device and system with a built-in characteristic that spontaneously circulates a cooling flow at low pumping capacities.

(2) To eliminate the wasteful energy consumption in the conventional method of pump overheating protection.

(3) To eliminate the need of external control for the bypass flow.

(4) To eliminate the control hunting problem in the bypass flow.

(5) To eliminate system flow shocks caused by the bypass control and thereby improve the system stability.

(6) To provide a pumping system which is absolutely safe from overheating and thereby improve the system reliability and safety.

(7) To reduce the engineering complexity, maintenance and plant down-time in which centrifugal pumps are utilized.

(8) To eliminate the corrosion problem in the bypass components caused by the high energy dissipation of the bypass flow in the conventional installations.

SUMMARY OF THE DISCLOSURE

The present invention relates to a fluid machine that consists two parallel pumping mechanisms. Said pumping mechanisms are designed to have a characteristic that provides two distinguishable pump operating cycles, namely the normal pumping cycle at normal capacities and the recirculating cycle at low capacities. At normal flow rate, when pump cooling is not needed, both pumping mechanisms promote forward flows which combine in the discharge casing to form resulted pump discharge flow. When the discharge flow is reduced to a certain low level the pump will spontaneously switch to the recirculating cycle, in which the first pumping mechanism pumps forwardly and produces a head that overpowers the second pumping mechanism to force a net reverse flow through the impeller passages thereof. The reverse flow will subsequently return to the upstream reservoir through the suction line of the second pumping mechanism. In order to establish said recirculating cycle, the first pumping mechanism must be designed with a shutoff head, say H1, higher than that of the second pumping mechanism, say H2. In a throttled flow control system, the system flow reduction is achieved by an increase of the system head and therefore low system flows correlate with high system heads. When the system flow is throttled to a level such that the system head becomes higher than H2, the second pump mechanism can no longer pumping forward against the system head and it starts to receive a reverse flow affected by the first pumping mechanism. It is an unique feature in the present invention that it maintains a net flow through at least one of the two pumping mechanisms at any system flow rate, including at system shutoff. In the recirculating cycle the second pumping mechanism, which functions now as a hydraulic turbine, converts the hydraulic energy of the reverse flow into mechanical shaft energy and then transmits it back to the rotational shaft of the rotor. Since the hydraulic energy is recovered by a turbine action, there is no need for dissipating the useful energy in the bypass line as in the conventional method. This not only saves a considerable amount of energy but also eliminates the component corrosion problem caused by the high energy dissipation which is common in conventional bypass installations.

In accordance with the present invention, each of said pumping mechanisms contains a centrifugal impeller for providing pumping action and a suction chamber for supplying an inlet flow to the impeller eye. Said impellers are mounted on a common rotational shaft and they are hydraulically baffled from each other in the axial direction. The discharge flows of impellers are collected by a common discharge casing which has a unique additional function in the present invention, that is to communicate the two impellers at their high pressure ends. The total head, the sum of the kinetic and static heads, at the impeller discharge is a continuous and decreasing function of the impeller through-flow. The desired hydraulic characteristic can be obtained by selecting a higher shutoff head for the first impeller. The pump normally operates with a discharge head lower than the shutoff heads of both impellers. In this operating cycle both impellers have positive forward through-flows. As the pump discharge flow reduces to a certain low rate, the pump discharge head will rise over the shutoff head of the second impeller. At this point the flow in the second pumping mechanism starts to reverse its direction and the pumping mechanism is converted into a hydraulic turbine. The reverse flow will subsequently return to the upstream reservior through the suction line connetion to the second pumping mechanism. In terms of turbomachinery, the normal flow cycle and the recirculating cycle in the present invention can be also referred as pump-pump cycle and pump-turbine cycle, respectively. The pump-turbine cycle of the present invention can be closely compared with a hydraulic torque convertor, except that in the present invention the output torque is transmitted by the common shaft to the prime mover. The hydraulic theory developed for torque convertor can be directly used in analying and designing the present invention, although the two devices serve for entirely different engineering purposes. It is important to understand that the pump-turbine action takes place internal the discharge casing and it involves direct kinetic energy transmission, in accordance with the present invention. In this energy conversion process the efficiency is much higher than the product of efficiencies of the pump and the turbine, for it does not need kinetic-static energy conversion which is responsable for major hydraulic losses in turbomachines.

Since the pump cooling and energy recovery mechanisms are built in the pump design and installation, there is no need for any external bypass control as in a conventional system. The high initial costs and complicated maintenance are thus eliminated. It is also a significant advantage of the present invention that the pump discharge flow is a continuous variable in the entire range of the pump capacity so that the system flow can be controlled smoothly in response to the system demand without experiencing any flow shock.

BRIEF DESCRIPTION OF DRAWINGS

Other objects and advantages will become apparent from the following description when read in connection with the accompanying drawings in which:

Referring to FIG. 1, a preferred embodiment in accordance with the present invention comprises a rotational shaft 21 driving a rotor assembly 10 which is divided by a central baffle 11 into two sides. Each side of the rotor has an impeller, say the first impeller 12 and the second impeller 13. Each impeller has multiple vanes for providing centrifugal impelling action. The suction eyes of the impellers 16 and 17 communicate with two separated suction chambers 18 and 19 respectively. The discharge prepheries 14 and 15 of both impellers are housed by a common discharge casing 20 which recieves the impeller discharge flows and converts the kinetic energy into static head therein. Said pump suction chambers 18 and 19 are connected to a upstream reservior 45 through two suction lines 41 and 42 as shown in FIG. 2. The exit nozzles 43 and 46 of the reservior 45 in FIG. 2 and FIG. 3 are separated by a hydraulic path of a desirable length so that a internal flow 49 from nozzle 46 to nozzle 43 will generate sufficient mixing with the reservior fluid 47, when the pump operating in the recirculating cycle as shown in FIG. 3. The mixing is necessary for dissipating the heat generated by the pump in said reservior.

FIG. 2 and FIG. 4 depict the normal flow path of the pumping system and in the pump respectively. In the normal flow cycle the impellers 12 and 13 pump parallelly to form the combined pump discharge flow. The pump discharge equals the sum of the impeller through-flows. When the pump discharge is reduced by the system demand, the pump will switch to the recirculating cycle as depicted by FIG. 3 and FIG. 5. In this cycle the flow in the second impeller is reversed by the higher hydraulic head of the first impeller. Therein the second impeller 13 reacts now like a hydraulic turbine which absorbs the contained energy in the reverse flow and transmits it back to the rotational shaft 21. The reverse flow will then return to the reservior 45 to complete the recirculation as shown in FIG. 3.

The hydraulics of the pump in accordance with the present invention can be better understood from the performance characteristics of the individual impellers as shown in FIG. 6. Curve 1 and curve 2 denote the impeller discharge heads as a function of the through-flows for the first impeller and the second impeller respectively. The first impeller is purposelly designed with a higher shutoff head as denoted by H1, while H2 denotes the lower shutoff head of the second impeller. Curve 3 represents the pump discharge head-capacity characteristic which is constructed by combining curve 1 and curve 2 in such a manner that the capacity of the pump, curve 3, equals the algebraic sum of the two impeller through-flows, curve 1 and curve 2, at the same head. The vertical line SA separates the pump operation into two cycles; the normal pumping cycle at right and the recirculating cycle at left. It can be seen, for example, when pump discharge flow OQ is greater than OA, both impellers have positive through-flows, OE and OF. These two flows combine in the common discharge casing to form the resulted discharge pump flow. When the pump discharge flow is reduced by the system demand below the critical capacity OA, the pump head becomes higher than the shutoff head of the second impeller H2, and the through-flow of the second impeller will have a negative value. In FIG. 6 point J of curve 3 denotes an operating point in the recirculating cycle. The horizontal line passing J intersects curve 2 at point P and curve 1 at point K. Point P represents the operating condition of the second impeller corresponding to the pump operating point J. The negative capacity of point P indicates a reverse flow from the discharge casing to the second suction chamber through the passages of the second impeller. In this operating cycle, the recirculating cycle, the forward flow of the first impeller, OG, splits into two flows; one exits to the main discharge line through the pump discharge nozzle and the other returns to the upstream source through the second suction line. By conservation of mass, the pump discharge flow OD must equal to the difference of the forward flow OG less the reverse flow OC as shown in FIG. 6. In the special case of pump shutoff, the positive flow of the first impeller OL equals the negative flow of the second impeller OM.

The reverse flow in the recirculating cycle of the present invention has a different hydrodynamic characteristic from that of an ordinary pump when driven by a reverse flow in the discharge line. In the latter case the reverse flow has to enter to the casing from the discharge nozzle that faces the opposite direction of the impeller rotation. This will cause vigorous turbulence and high energy dissipation in the casing. An effective turbine action relies on the conversion of the available energy into velocity that has a tangential direction to the rotor rotation. In the present invention the reverse flow is supplied from the discharge flow of the first impeller. Since the two impellers rotate in the same direction, the flow enters the passages of the second impeller with a substantial tangential velocity of the impeller rotation. Therefore, the kinetic energy of the flow is directly utilized in the turbine action without the process of conversion into pressure head. This eliminates the casing losses and thereby achieves a high efficient energy recovery. The recovered torque is then transmitted to the common rotational shaft and consequently results in a substantial power saving at low pump capacities.

Figure 1:
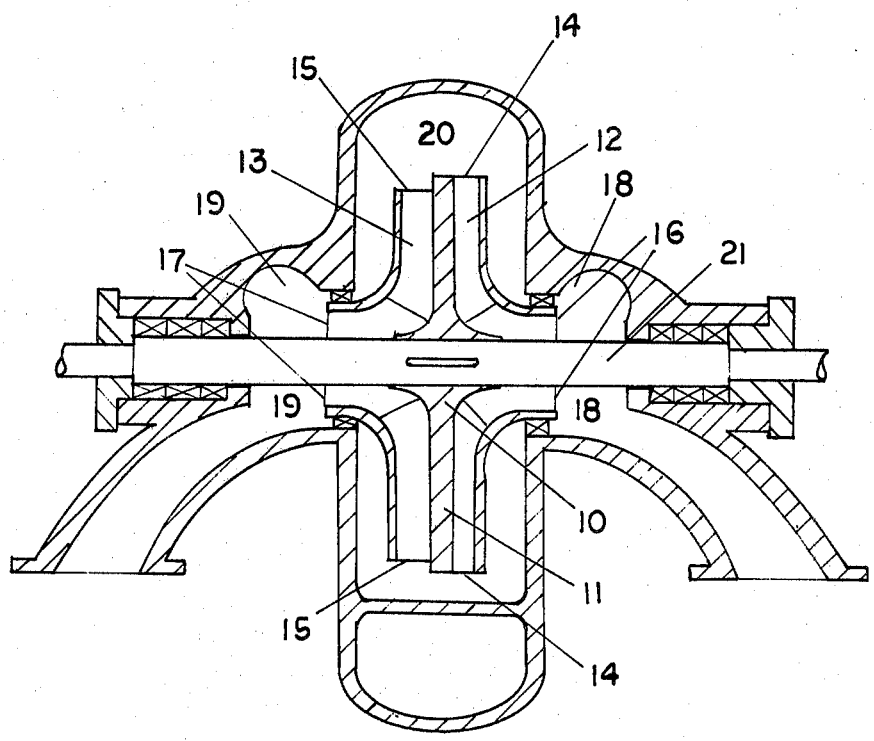
FIG. 1 is a cross-section view of a centrifugal pump in accordance with the present invention.
Figure 2:
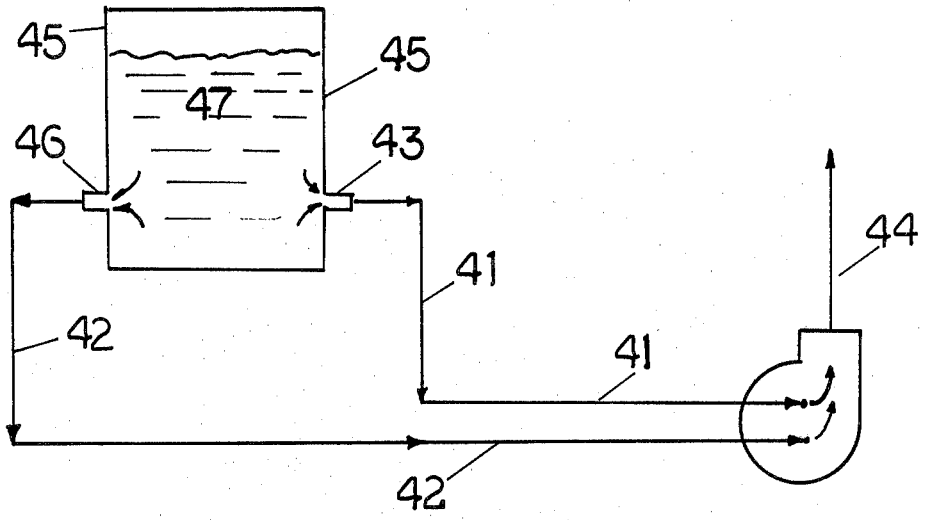
FIG. 2 is a schematic and diagrammatic view of the pumping system when operating in the normal flow cycle in accordance with the present invention.
Figure 3:
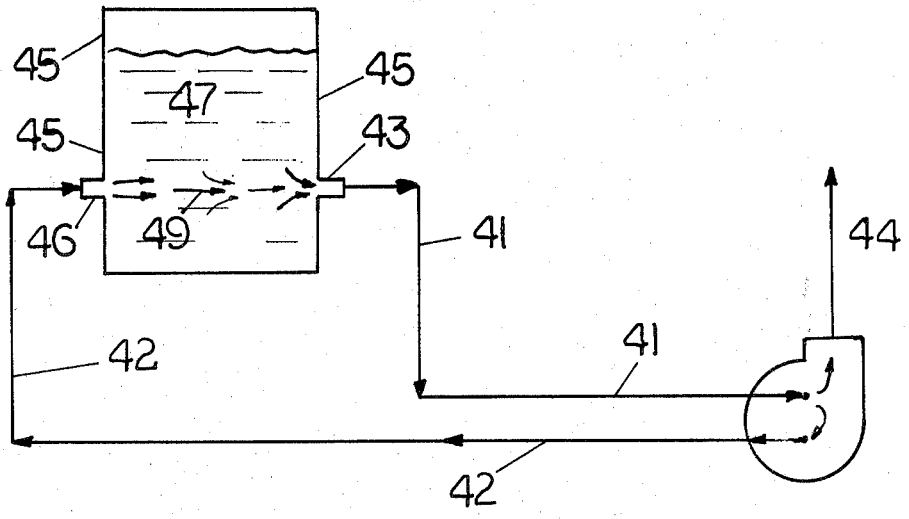
FIG. 3 is a schematic and diagrammatic view of the pumping system when operating in the recirculating cycle in accordance with the present invention.
Figure 4:
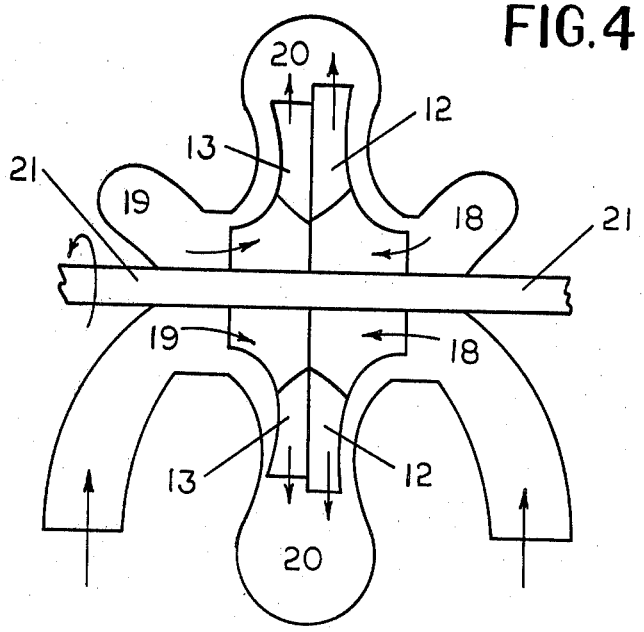
FIG. 4 is a schematic section view that depicts the flow path in the pump when operating in the normal flow cycle in accordance with the present invention.
Figure 5:
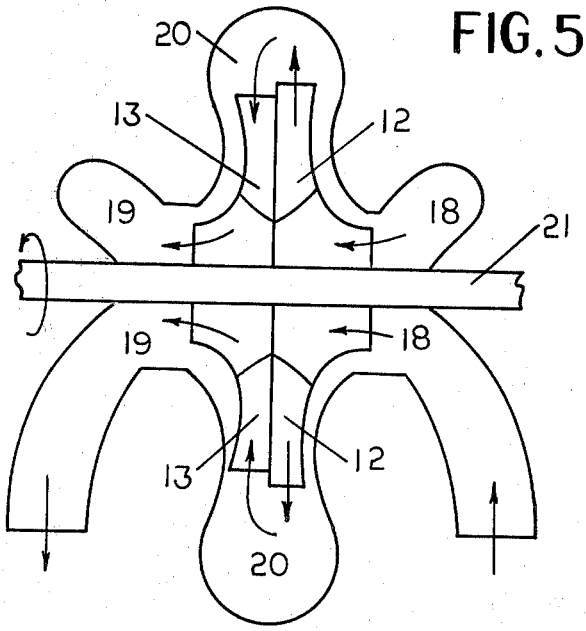
FIG. 5 is a schematic sectional view that depicts the flow path in the pump when operating in the recirculating cycle in accordance with the present invention.
Figure 6:
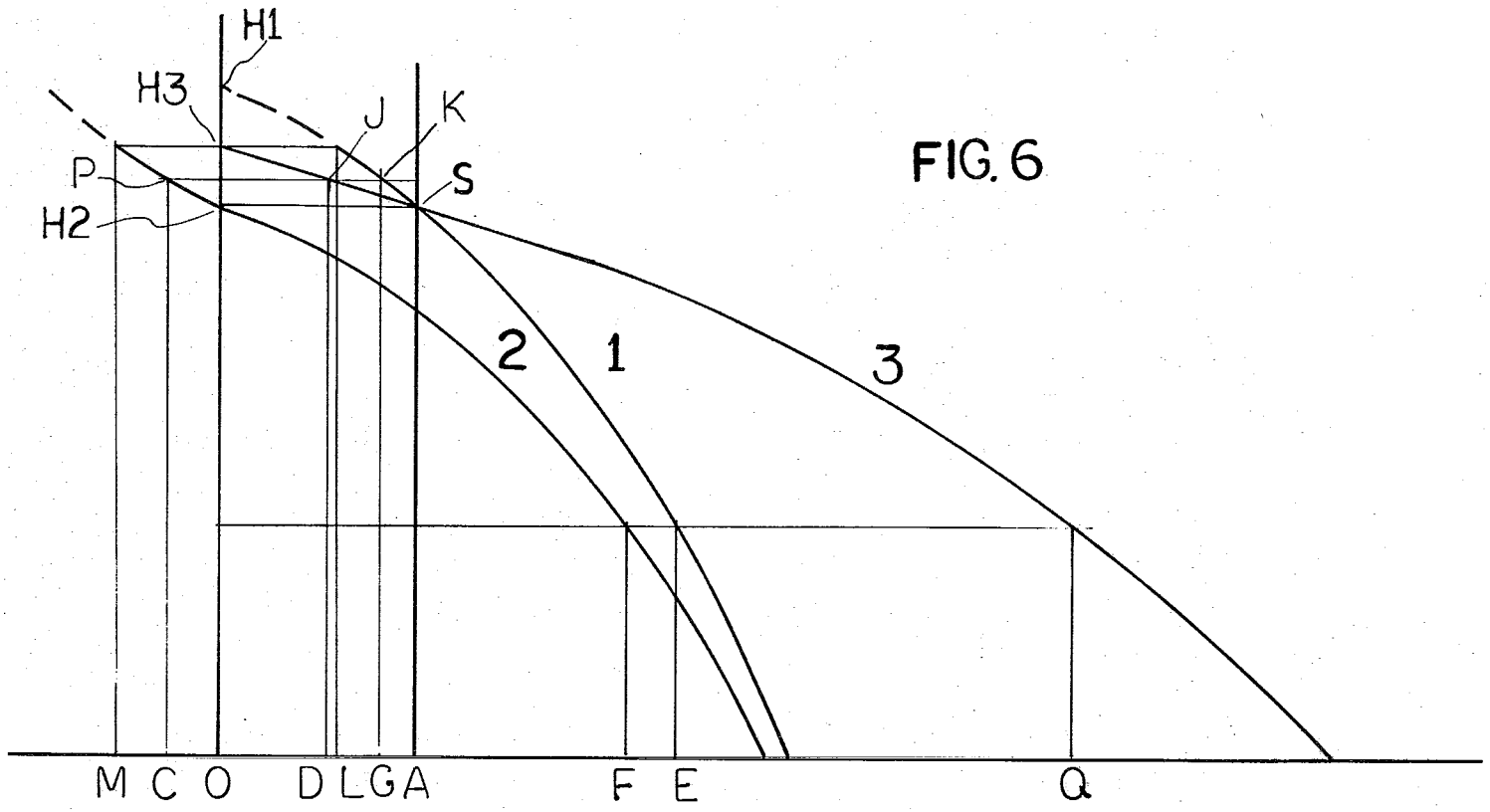
FIG. 6 is a graphic presentation of the pump performance characteristic.
Figure 7:
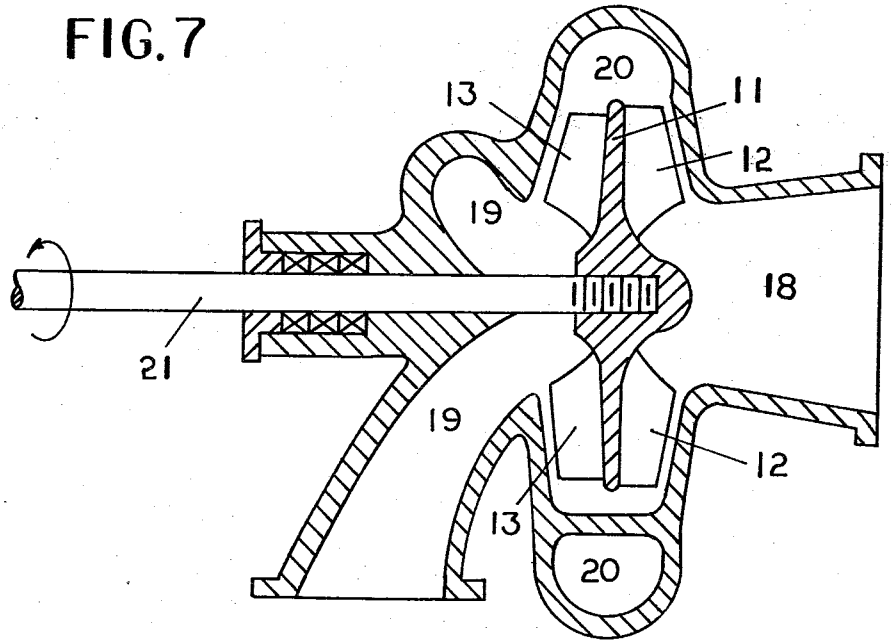
FIG. 7 is a cross-section view of another preferred embodiment that has an end suction design and open impellers in accordance with the present invention.

The first and second suctions 16 and 17 in FIG. 1 are designed with side suction arrangement in which the rotational shaft penetrates through both suctions. In this specific arrangement the shaft is generally supported by bearings at both ends. The advantages of the design include a more stable rotor dynamics and mininum axial thrust. However it requires seals or packings at both ends. It is sometimes more feasible to have an end suction on one end and a side suction at the other end as shown in FIG. 7. In this design the pump shaft is supported and sealed only at the end of side suction. The pump can be coupled with the driving motor in the same manner as in a conventional end suction pump.

The impeller discharge head is a function of impeller diameter, number of vanes, discharge vane angle and other design parameters. The desired hydraulic characteristic of the present invention can be obtained by mismatching one or more of the above mentioned parameters for said two impellers. For instance, FIG. 1 shows that the first impeller 12 has vanes with a larger outer diameter than that of the second impeller 13. Theoretically, the shutoff head of a given impeller is proportional to its vane diameter squared. The greater vanes produce a higher shutoff head as desired by the present invention. As a design practice of the present pump the mismatached dimensions are selected so that it provides a recirculating flow that is predetermined to be sufficient for pump cooling at pump shutoff and low capacity operations.

It is understood that the present specification has disclosed an invention with new concepts for energy saving and pump overheating protection. The embodiments which have been described can be modified in numerous ways without departing from the scope of the present invention as defined in the appendant claims.

I claim:

1. A centrifugal pump for pumping fluid comprising a first and a second suctions for recieving said fluid from a first and a second suction lines; said first and second suctions being hydraulically separated, a first and a second impellers rotating with a common shaft; said first impeller being baffled from said second impeller in the axial direction, the high pressure ends of said first and said second impellers being housed by a common discharge casing and the inlets of said first impeller and said second impeller communicating with said first suction and said second suction respectively; said first and said second impellers having a combined hydraulic characteristic that dividing the pump operation into two operating cycles, namely the normal pumping cycle and the recirculating cycle; in said normal pumping cycle said first and said second impeller providing forward flows, i.e. flows from said suctions to said common discharge casing; when pump discharge flow being reduced below a predetermined flow rate said pump operation switching spontaneously to said recirculating cycle, in which said first impeller pumping forward and forcing a net reverse flow from said common discharge casing to said second suction through the passages of said second impeller, said reverse flow subsequently returning to a upstream source through said second suction line to complete the recirculation, thereby said pump being protected from overheating by said recirculating cycle at low pumping capacities.

2. A centrifugal pump as claimed in claim 1, said combined hydraulic characteristic being provided by that said first impeller having vanes with a large outer diameter than that of said second impeller, thereby said first impeller producing a higher discharge head and forcing a reverse flow through said second impeller passages at substantially low pumping capacities.

3. A centrifugal pump as claimed in claim 1, said first impeller and said second impeller being provided on two sides of an integral rotor assembly.

4. A centrifugal pump as claimed in claim 1, said first and said second impellers being shrouded impellers.

5. A centrifugal pump as claimed in claim 1, said first and said second impellers being open impellers.

6. A centrifugal pump as claimed in claim 1, said first and said second suctions being side suctions.

7. A centrifugal pump as claimed in claim 1, said first suction being an end suction.

8. A process for pumping fluid comprising:

a. withdrawing said fluid from a fluid source through a first outlet and a second outlet; said first and said second outlet being separated by a flow path of a desirable distance such that an internal flow in the fluid source from said second outlet location to first outlet location generating sufficient mixing with said fluid in said source, b. connecting said first outlet to a first pumping mechanism through a first suction line and connecting said second outlet to a second pumping mechanism through a second suction line; said first and said second pumping mechanisms sharing a common casing and they having a combined hydraulic characteristic that they pumping parallelly to form a combined discharge flow at substantially normal flow capacities and said first pumping mechanism forcing a reverse flow through the second pumping mechanism when flow capacity being reduced substantially below the normal capacity; said reverse flow returning subsequently to said fluid source through said second suction line and said second outlet to complete a circulating flow, thereby said process for fluid pumping providing a spontaneous circulating flow in response to flow reduction for pump overheating protection.

* * * * *